United States Patent [19]

Schnell

[11] 4,257,488

[45] Mar. 24, 1981

[54] GUIDE FRAME FOR A PILE DRIVING DEVICE

[75] Inventor: Hans G. Schnell, Hamburg, Fed. Rep. of Germany

[73] Assignee: Van Kooten B.V., Naarden, Netherlands

[21] Appl. No.: 577,844

[22] Filed: May 15, 1975

[30] Foreign Application Priority Data

May 20, 1974 [NL] Netherlands ..... 7406774

[51] Int. Cl.[3] ..... E02D 7/00

[52] U.S. Cl. ..... 173/133; 405/232

[58] Field of Search ..... 61/53.5; 173/131, 128, 173/129, 130, 132, 133

[56] References Cited

U.S. PATENT DOCUMENTS

| | | | |
|---|---|---|---|
| 1,769,169 | 7/1930 | Thornley | 173/132 X |
| 2,126,409 | 8/1938 | Pfeiffer | 173/131 X |
| 3,242,997 | 3/1966 | Tokola | 173/131 |
| 3,998,391 | 3/1970 | Guild et al. | 173/131 |

*Primary Examiner*—William F. Pate, III

*Attorney, Agent, or Firm*—Lewis H. Eslinger

[57] ABSTRACT

A guide framework for guiding a hammer in driving piles into subaqueous ground, said framework comprising a socket slidingly engaging the pile by means of a passage and at least one guide stay secured to the socket for guiding the hammer, the guide stay of said framework being detachably secured to the socket. As a result parts of the guide framework can be changed and the quantity of steel to be kept on stock for guide frameworks is small.

3 Claims, 8 Drawing Figures

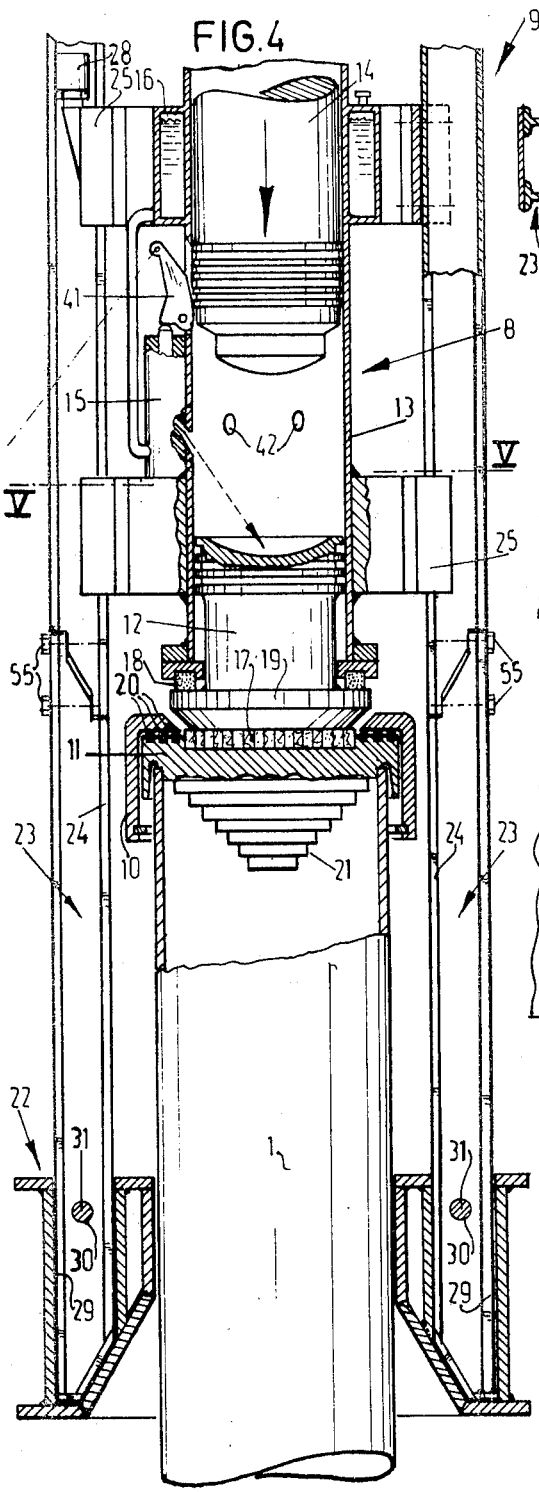
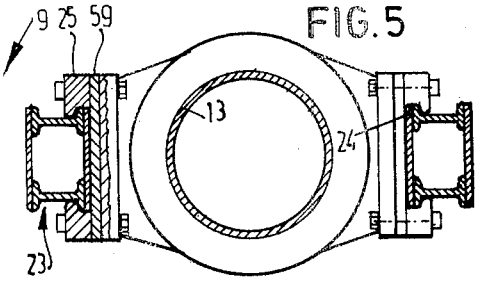
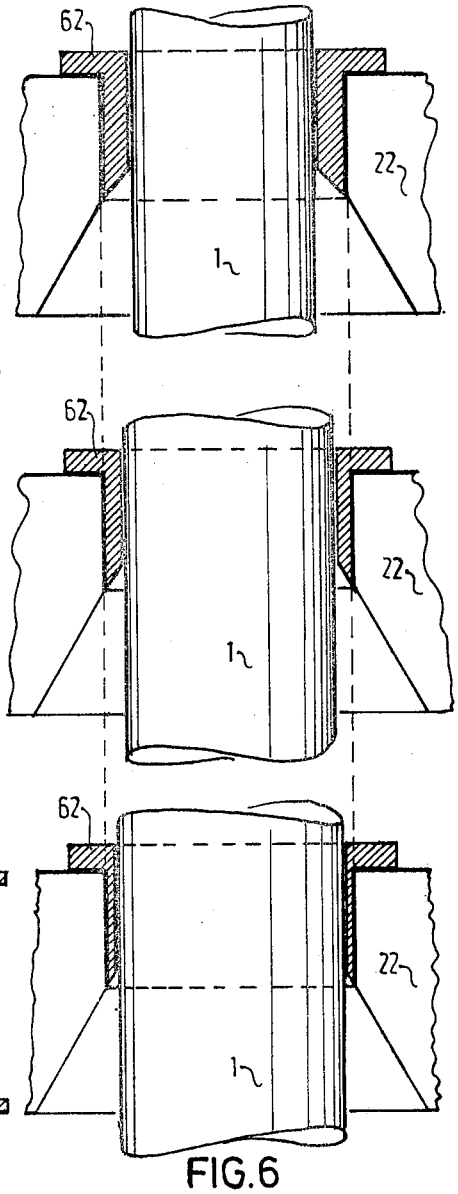
FIG.6

GUIDE FRAME FOR A PILE DRIVING DEVICE

The invention relates to a guide frame for guiding a hammer in driving piles into subaqueous ground said frame comprising a socket slidingly fitting around the pile by means of a passage and at least one guide stay secured to the socket for guiding the hammer.

Such a guide framework is known. The guide framework comprises a cage made by welding. This cage is bulky and requires much storage space. If, as is usually the case, piles of different diameters have to be driven in, the storage space is particularly large with regard to the great number of required cages on board a vesser or in a store on land.

Since the cages of this kind are expensive, they require a large amount of investment. On account of the high costs of investment a supplier, therefore, tends to manufacture the cages not until has the order been given, which gives, of course, rise to long terms of delivery and to stagnation of the constructions.

The invention has for its object to render the quantity of material involved in a guide framework more standardized or at least more suitable for driving piles of different diameters by means of different hammers.

For this purpose the guide stay can be secured to the socket in a detachable manner. According to the invention a guide framework for driving a pile of a given diameter can be assembled within a short period of time from a separate socket from stock and a separate guide stay also from stock, whilst, if necessary, adjusting pieces are arranged in the socket around the pile to be driven and between the hammer and the guide stay. In accordance with the invention one and the same guide stay or one and the same of guide stays may be employed in conjunction with a specimen selected among the various sockets. The separate sockets and guide stays on stock require considerably less space than cage-like guide frames, whilst, moreover, their weight is materially smaller so that a floating derrick of lower lifting power may be employed. When piles of larger diameter than ever driven in before have to be used, the stock of guide stays may still suffice, it only being necessary to provide a socket for completion, which socket, owing to its small bulk and the comparatively small investment, can be kept on stock by the supplier without great objection.

The invention furthermore relates to a socket for use in a guide framework and comprising a passage for a pile to be driven and is characterized by at least one recess for an upright stay, which can thus be loosely accommodated and by at least one lock bolt guide extending transversely of said recess.

The socket is preferably provided with at least one additional recess for loosely engaging a rail for the driving cap guide.

A storage for parts of guide frames in accordance with the invention is characterized by at least one series of sockets to be detachably fastened to guide stays, each socket having a passage for a pile and at least one guide stay recess, the passages for the piles being different and the recesses being identical.

The aforesaid and further features of the invention will be described more fully in the following description with reference to a drawing.

In the drawing:

FIG. 4 shows on a further enlarged scale a sectional view taken on the line IV—IV in FIG. 2.

FIG. 5 is a sectional view taken on the line V—V in FIG. 4.

FIG. 6 is a schematic survey of driving piles of smaller diameters.

Figure 1:
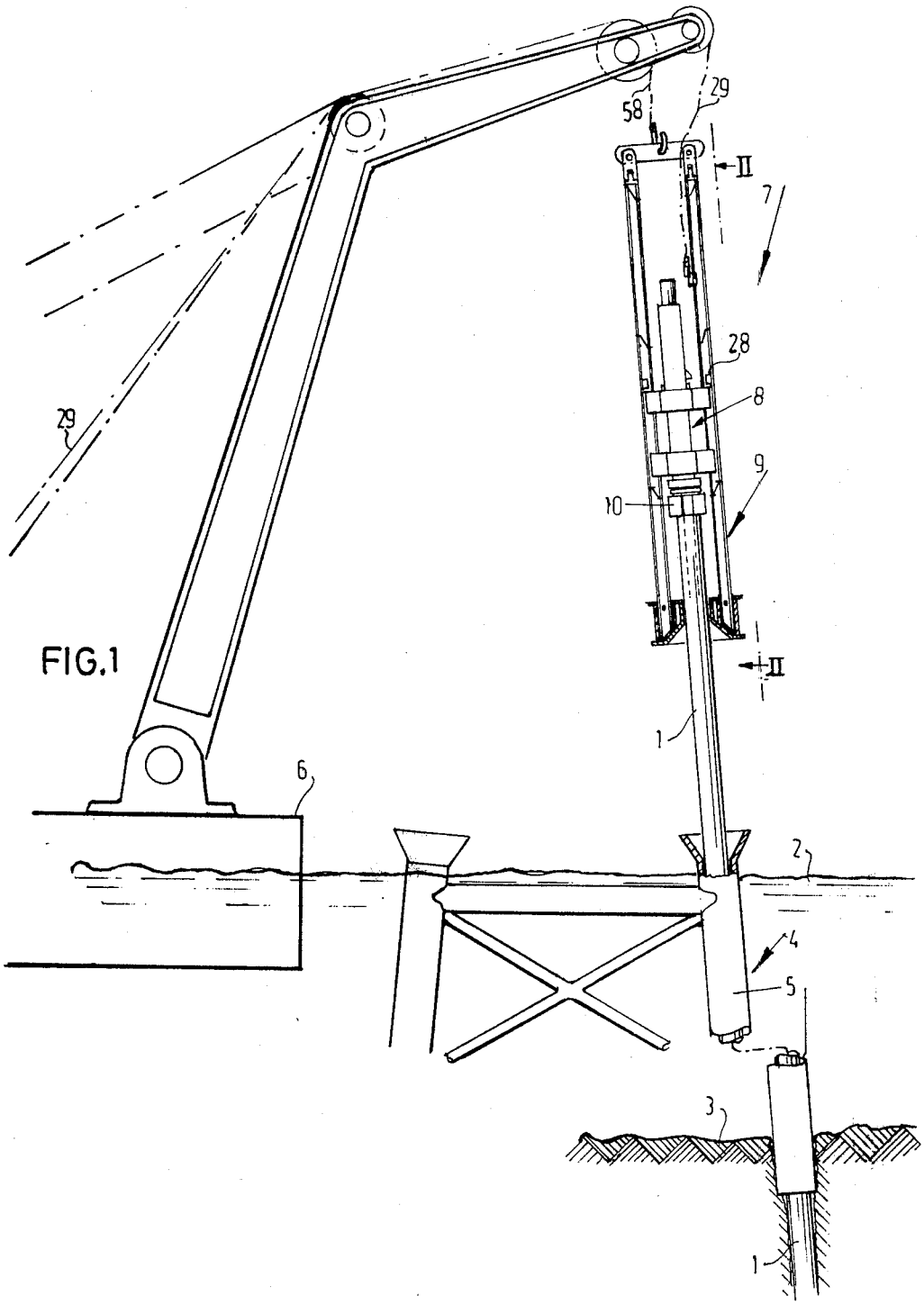
FIG. 1 is a schematic survey of the driving operation by means of a driving apparatus comprising a guide framework in accordance with the invention.

Before each pile 1 is driven into a soil 3 under the water surface 2, first a setting frame 4 is disposed on the soil 3, said frame having guide cylinders 5 determining the place and the direction of the piles 1 to be driven. Around the pile 1 to be driven a pile driving device 7 is arranged on the pile 1 by means of a floating derrick 6.

The pile driving device 7 comprises a hammer 8, a guide framework 9 for guiding the hammer 8 and a driving cap guide 10 bearing on the driving cap 11. The hammer 8 shown in FIGS. 1 to 4 is constructed in the form of a known Diesel hammer comprising a cylinder 13, a heavy piston 14, a rammer 12 sealed from the cylinder 13 and a fuel pump 15 communicating with a fuel tank 16 connected with the cylinder 13.

The rammer 12 bears on the driving cap 11 through a wooden intermediate layer 17. The cylinder 13 bears through rubber cushions 18 on a collar 19 of the rammer 12. The driving cap guide 10 bears on the driving cap 11 with the interposition of rubber rings 20, said cap bearing by a central portion 21 on the pile 1. If the pile 1 is tubular, it engages the periphery of said central portion 21.

Figure 2:
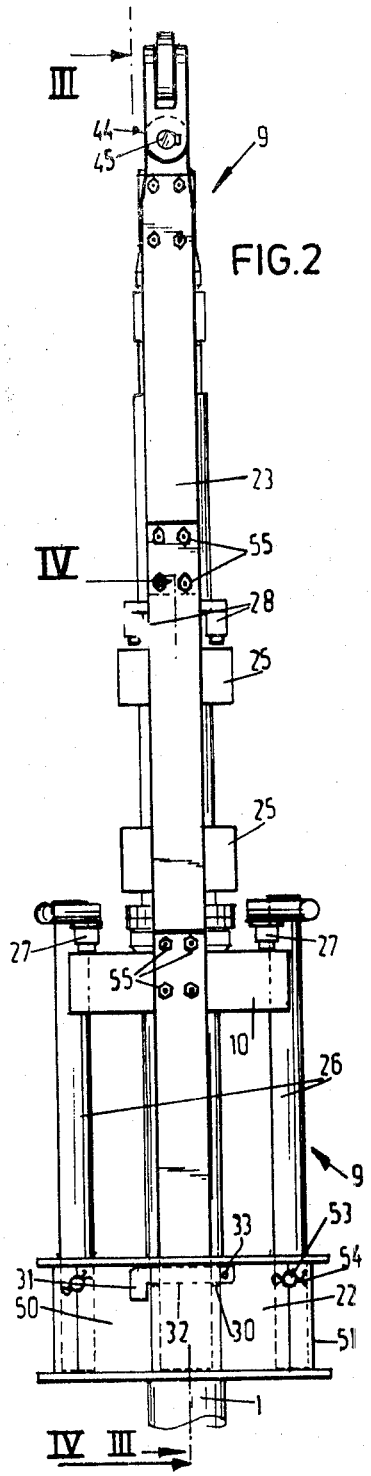
FIG. 2 is an enlarged side elevation taken in the direction of the arrows II in FIG. 1.

The guide framework 9 of FIGS. 1, 2 and 4 comprises a socket 22, two upright guide stays 23 detachably fastened to the former and provided with rails 24 for guiding the cylinder 13 by means of guide members 25 and two upright tubular rails 26, secured in a detachable manner to the socket 22.

Figure 3:
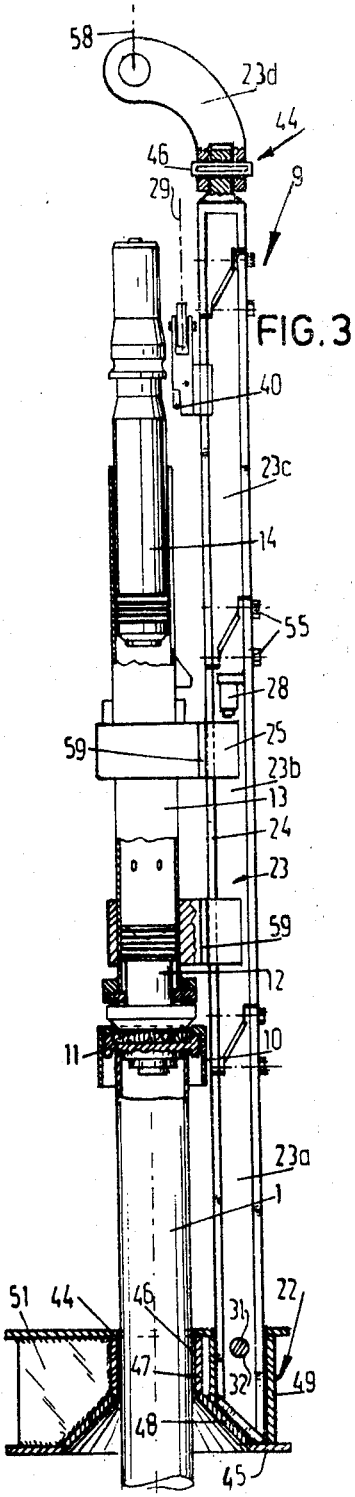
FIG. 3 is a sectional view taken on the line III—III of the pile driving device shown in FIG. 2 in a slightly different embodiment.

It is imaginable to use only one guide stay 23 of the kind shown in FIG. 3 instead of employing two guide stays 23 of the kind shown in FIGS. 1, 2 and 4, if the top end **23*d* is a rigid hook engaged centrally by a cable 58**.

The guide framework 9 bears on the one hand by means of four springs 27 supported by the rails 26 via the driving cap guide 10 on the pile 1 and on the other hand by means of four springs 28 secured to the guide stays 23 via the cylinder 13 and the rammer 12 on the pile 1.

The operation of each pile driving device 7 of FIGS. 1 to 4 is as follows. After the pile driving device 7 has been arranged on the pile 1, the piston 14 is lifted by means of a releasable hook 40 guided along rails 24 and lifted by means of a cable 29 from the derrick 6. When the piston 14 is released to drop down, it actuates via a control-member 41 the fuel pump 15, which sprays fuel to the rammer 12. The air contained in the cylinder 13 is compressed and the fuel ignites by the impact of the piston 14 on the rammer 12. By this stroke the pile 1 disappears over some length in the soil 3 and the piston 14 is lifted by the explosion so that the combustion gases emerge through ports 42, through which fresh air enters, after which the strokes are repeated.

Each guide stay 23 is detachably arranged with close fit in an upright guide stay recess 29 of the socket 22, said recess being defined by a cylinder 49 and having each a transverse lock bolt guide 30 formed by a horizontal bore for receiving a pin-shaped lock bolt 31, which extends across a corresponding lock bolt guide 32 of a guide stay 23. The lock bolt 31 is secured in place by means of a locking pin 33. The socket 22 comprises a top plate 44, a bottom plate 45, a tubular piece 47 determining a passage 46 for a pile 1, a cone 48 joining the same, two cylinders 49, vertical stiffening plates 50 and two upright cylinders 51 forming additional recesses 52 for detachably receiving of the upright round rails 26. Each rail 26 is secured to the socket 22 by means of a lock bolt 53 passed through the rail and the cylinder 51 and by means of a safety pin 54. Each guide stay 23 comprises a lower end 23*a* to be fastened to the socket 22, stay portions 23*b* and 23*c* and a top end 23*d*, which are rigidly secured to one another by means of bolts 55. The top ends 23*d* of the two guide stays 23 are interconnected by means of a link 57 and suspended to a cable 58 of the derrick 6. The link 57 has a large number of bolt holes 56 so that definite bolt holes can be chosen in accordance with the distance between the guide stays 23. Each guide member 25 is adapted to engage the periphery of the rails 24 of the guide stay 23 and with the interposition of a plateshaped adaptor 59 it is fastened by bolts to the cylinder 13, the thickness d of the adaptor 59 being such that the cylinder 13 is in line with the tubular piece 47 (see FIGS. 5 and 6). If with a given pile driving operation a lighter hammer 8 may be employed, the guide along the guide stay 23 can be carried out in line with the pile 1 by inserting a thicker adaptor 59.

FIG. 6 shows three piles 1 of slightly different diameters, each of which can be driven in by means of one and the same socket 22, if a matching calibrating tubular 62 of different inner diameter and the same outer diameter as the pile 1 of FIG. 4 is inserted into the passage 46.

Figure 7:
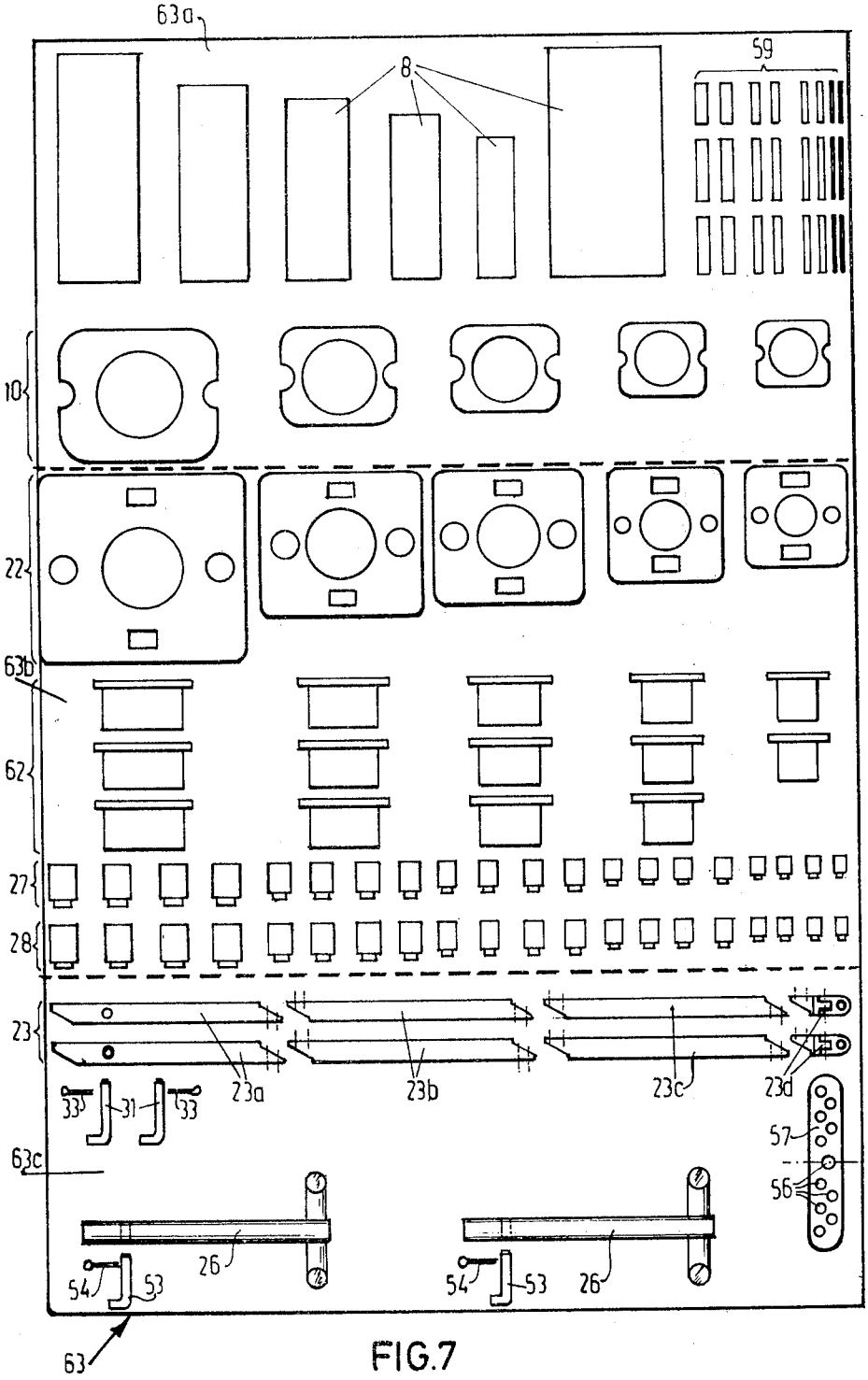
FIG. 7 shows a storage holding parts of guide frameworks embodying the invention and FIG. 8 is a side elevation partly broken away of a further pile driving apparatus in accordance with the invention.

FIG. 7 shows a store 63 containing parts of a guide framework 9 embodying the invention to be assembled within a short period of time. The storage 63 is considered to be divided into three compartments, that is to say:

Compartment 63*a* for hammers 8 and adaptors 59 for matching the former, driving cap guides 10 and driving caps 11 (not shown);

Compartment 63*b* comprising sockets 22, the associated calibrating tubings 62 and springs 27, 28 and Compartment 63*c* containing parts adapted for a considerably more universal use, that is to say: guide stay portions 23*a*, 23*b*, 23*c* and 23*d*, links 57, rails 26 and the aforesaid required connecting means such as the bolts 31 and 53 and the safety locking pins 33 and 54.

FIG. 7 shows a plurality of sockets 22. A supplying industry may have on stock one or more series of sockets having passages of, for example 42", 54", 66", 78" and 90" having, however, identical guide stay recesses 29. Preferably also the additional recesses 52 are identical, at least with the three larger and the two smaller sockets 22 respectively.

Figure 8:
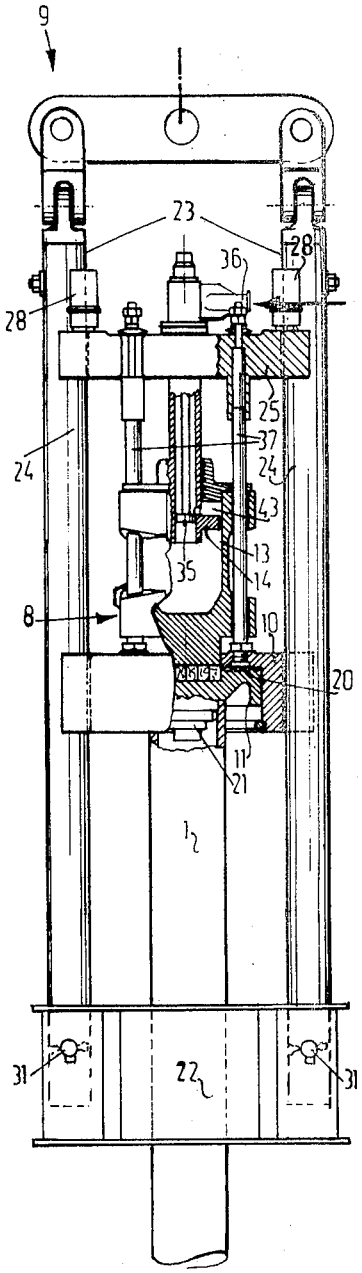

FIG. 8 shows a steam hammer 8 comprising a heavy cylinder 13, a piston 14 firmly secured to a guide member 25 and a steam inlet 36 controlled by a steam slide 35. The driving cap guide 10 is rigidly secured by setting rods 37 to the guide member 25. The guide member 25 is displaceable along the upright rails 24 of guide stays 23, which together with the socket 22 again form a guide framework 9. The framework 9 bears on the pile 1 by means of springs 28, the guide member 25, the setting rods 37, the driving cap guide 10, the rubber rings 20 and the driving cap 11.

The pile driving device shown in FIG. 8 operates as follows.

By opening the steam slide 35 the cylinder 13 is lifted with respect to the stationary piston 14. In the top position of the cylinder 13 the steam slide 35 is lifted so that the steam can escape from the top chamber 43 of the cylinder 13. The cylinder 13 drops down and drives the pile 1 slightly further into the soil 3. The return stroke of the pile 1 is transferred through the rubber washers 20, the driving cap guide 10, the rods 37, the guide member 25 and the springs 28 to the guide framework 9. The guide stays 23 of FIG. 8 have a circular section; they also guide the driving cap guide 10 and bear the springs 28. The top end 23*d* has a hinge 4, which allows by a shaft 45 without keys (FIG. 2) the link 57 to turn with respect to the guide stay 23, but which is blocked by means of a key shaft 46 (FIG. 3) against such a turn.

What I claim is:

1. A guide framework for guiding the pile driving hammer of a pile driving assembly for driving piles into subaqueous ground, comprising a socket and at least one guide stay for guiding the hammer assembly, said socket comprising a tubular member having an axial passage slidingly and movably surrounding the pile to permit relative sliding movement therebetween, and a cone rigidly connected to said tubular member at the lower side thereof and joining the same, said cone diverging downwards, said socket having a vertical guide recess formed therein associated with each guide stay for receiving the lower end of its associated guide stay therein, said guide stay and said socket each having lock bolt guides formed therein positioned to be aligned when the guide stay is in the socket, and a lock bolt received in said lock bolt guides extending transversely through said stay and said socket for detachably securing said guide stay to said socket.

2. A guide framework as claimed in claim 1, including means for detachably securing at least two guide stays to said socket, whereby the lower ends of the guide stays are rigidly interconnected to each other through said socket.

3. A socket for a guide framework for guiding the pile driving hammer of a pile driving assembly for driving piles into subaqueous ground, said socket comprising a tubular member having an axial passage slidably and movably surrounding the pile to permit relative sliding movement therebetween, and a cone rigidly connected to said tubular member at the lower side thereof and joining the same, said cone diverging downwards, said socket having at least one upright guide stay recess formed therein for loosely engaging a guide stay, and at least one lock bolt guide extending transversely of said recess; and at least one additional vertical recess provided in said socket for detachably receiving a standing rail for guiding a driving cap guide of the hammer assembly.

* * * * *